US006793441B2

(12) United States Patent
Shimizu et al.

(10) Patent No.: US 6,793,441 B2
(45) Date of Patent: Sep. 21, 2004

(54) TUNNEL WATERPROOFING METHOD

(75) Inventors: Sachio Shimizu, Tokyo (JP); Keiichi Kosuge, Machido (JP)

(73) Assignee: W. R. Grace & Co.-Conn., Columbia, MD (US)

( * ) Notice: Subject to any disclaimer, the term of this patent is extended or adjusted under 35 U.S.C. 154(b) by 0 days.

(21) Appl. No.: 10/297,360

(22) PCT Filed: Jun. 5, 2001

(86) PCT No.: PCT/US01/18239

§ 371 (c)(1),
(2), (4) Date: Dec. 5, 2002

(87) PCT Pub. No.: WO01/96709

PCT Pub. Date: Dec. 20, 2001

(65) Prior Publication Data

US 2003/0129029 A1 Jul. 10, 2003

(30) Foreign Application Priority Data

Jun. 12, 2000 (JP) ..... 2000-175769

(51) Int. Cl.[7] ..... E21D 11/10

(52) U.S. Cl. ..... 405/150.2; 405/150.1; 405/146

(58) Field of Search ..... 405/150.1, 150.2, 405/146–148, 151–153; 524/575.5, 332.5, 332.6

(56) References Cited

U.S. PATENT DOCUMENTS

| | | | | |
|---|---|---|---|---|
| 3,545,213 A | | 12/1970 | Sebor et al. | 61/45 |
| 4,247,221 A | | 1/1981 | Lewer et al. | 405/150 |
| 4,695,188 A | | 9/1987 | Pulkkinen | 405/150 |
| 4,714,057 A | * | 12/1987 | Wichart | 123/90.15 |
| 4,915,542 A | | 4/1990 | Fernando | 405/150 |
| 5,993,114 A | | 11/1999 | Jones | 405/150 |
| 6,193,439 B1 | | 2/2001 | Wolfseher | 405/150.2 |
| 6,403,686 B1 | * | 6/2002 | Pickett et al. | 524/310 |
| 2001/0002969 A1 | * | 6/2001 | Johansson | 405/150.1 |

FOREIGN PATENT DOCUMENTS

| | | | | |
|---|---|---|---|---|
| CH | 560811 | * | 4/1975 | |
| DE | 2532664 | * | 1/1977 | |
| DE | 2112046 A | | 11/1982 | E21D/11/38 |
| EP | 0 898 052 A1 | | 2/1993 | E21D/11/38 |
| JP | 61019683 | * | 1/1986 | |
| JP | 62 28478 | | 2/1987 | D06N/3/00 |
| JP | 01318699 | * | 12/1989 | 405/150.2 |
| JP | 03180699 | * | 8/1991 | 405/150.1 |
| JP | 03208995 | * | 9/1991 | 405/150.2 |
| JP | 04198597 | * | 7/1992 | 405/153 |
| JP | 06 055481 | | 3/1995 | E21D/121/10 |
| WO | WO 87/04756 | | 8/1987 | |
| WO | 8803598 | * | 5/1988 | |
| WO | WO 97/25484 | | 7/1997 | E02D/1/00 |
| WO | WO 98/24738 | | 6/1998 | C04B/41/71 |
| WO | WO 00/05487 | | 2/2000 | E21F/16/02 |

OTHER PUBLICATIONS

*Waterproofing Between Slab Floors*, LBI Technologies, Inc., (1995).
*Tunnel Opportunity*, Daily Mail.
*Strata Support Waterproofing*, DiNoia, Grace Performance Chemicals (2001).

* cited by examiner

*Primary Examiner*—Jong-Suk (James) Lee
(74) *Attorney, Agent, or Firm*—Craig K. Leon; William L. Baker

(57) ABSTRACT

A tunnel waterproofing method comprises spraying a primary coating of concrete onto the excavation surface of a tunnel, installing thereon a waterproofing sheet having an adhesive layer operative to bond with concrete, and spraying a secondary coating of concrete against the adhesive side of the waterproofing sheet. Preferably, a buffer water conducting sheet is established between the primary concrete coating sprayed onto the excavation surface and the waterproofing sheet.

11 Claims, No Drawings

TUNNEL WATERPROOFING METHOD

DETAILED DESCRIPTION OF THE INVENTION

1. Technological Field of the Invention

This invention relates to a waterproofing method for tunnels.

In this invention, paste, mortar and concrete are used as general terms to refer to cement concrete.

2. Prior Art

The principal tunnel construction method in Japan at present is the NATM method. The NATM construction method is a method in which primary coating is performed by means of spray mortar or spray concrete immediately after excavation of the tunnel to prevent falling of rock and water leakage in the excavation region, after which a secondary coating concrete is applied to stabilize the tunnel by maintaining tunnel strength. At this time, a waterproofing sheet is installed for the purpose of waterproofing and insulation between the primary coating concrete and the secondary coating concrete so that leakage of water into the tunnel can be prevented and so that cracks due to binding of the secondary coating concrete to earth mounds or movement of earth mounds can be prevented. Most recently, tunnel excavation has been performed by tunnel boring machines (TBM construction method) and waterproofing sheets are installed for the same objectives.

Further, because the width of the sheet is narrow, being 1 to 2 m, there are the problems that it takes great effort and trouble and it is uneconomical when the ends of the waterproofing sheets are overlaid on each other and joined by welding.

There is the further problem that water infiltrates between the waterproofing sheets and the secondary coating concrete due to damage of the waterproofing sheet functionally by poorly welded components and by irregularities in the excavation surface so that waterproofing capacity is not obtained.

[Problems the Invention is Intended to Solve]

When the thickness of the waterproofing sheets is increased in order to prevent damage to the waterproofing sheets, there are the problems that welding of the ends of the waterproofing sheets becomes difficult and that the mass of the waterproofing sheets is increased, with the result that actual execution characteristics become even poorer.

The inventors conducted various studies of the aforementioned problems. As a result, they perfected this invention by discovering a tunnel waterproofing construction method whereby a waterproofing sheet that is adhesive to the secondary coating cement concrete is installed on the primary spray cement concrete surface before installing the secondary coating cement concrete, and, in which, by making it into a single entity with the secondary coating cement concrete, infiltration of water between the waterproofing sheet and the secondary coating concrete because of poor weld sites and damage of the ends of the waterproofing sheets is prevented, leakage of water is prevented even when cracks are generated in the secondary coating cement concrete and waterproofing capacity can be greatly increased.

[Means for Solving the Problems]

Specifically, this invention is a tunnel waterproofing method characterized in that a primary spray cement concrete is sprayed on the excavation surface of the tunnel, after which a secondary coating cement concrete and a waterproofing sheet having adhesiveness are installed on said primary spray cement concrete surface such that the secondary coating cement concrete is established on said waterproofing sheet surface, [or] a tunnel waterproofing method characterized in that a primary spray cement concrete is sprayed on the excavation surface of the tunnel, after which a buffer-water conducting layer is established in said primary spray cement concrete surface, a secondary coating cement concrete and a waterproofing sheet having adhesiveness are installed on said secondary coating cement concrete such that the secondary coating cement concrete is established on said waterproofing sheet surface; and a tunnel waterproofing method further characterized in that the waterproofing sheet is a multilayer waterproofing sheet that has a layer that has adhesiveness with the installed secondary coating cement concrete.

[Mode of Execution of the Invention]

We shall now describe this invention in detail.

This invention is a construction method in which the waterproofing sheet and the tunnel are made into a single entity by spraying, preferably, a fast-drying cement concrete onto the excavated tunnel surface, after which a waterproofing sheet that is adhesive with the secondary coating cement concrete is installed. This waterproofing sheet allows for follow-up of cracking of cement concrete due to drying and contraction of the secondary coating cement concrete and of earth mounds after completion. By making the cement concrete and the waterproofing sheet into a single entity, contact with water occurs only in sites that are damaged even if damage to the waterproofing sheets occurs. For this reason, leakage of water does not occur as long as cracks do not develop in the secondary coating concrete in the region of the sheet damage. Therefore, water leakage is greatly decreased and excellent waterproofing capacity is obtained. Further, water leakage does not occur as with conventional waterproofing sheets as a result of water infiltrating between the waterproofing sheet and the secondary coating cement concrete, of impairment of the waterproofing capacity of the tunnel as a whole, and of cracks in the secondary coating cement concrete. Moreover, because a waterproofing sheet that is made into a single entity with the secondary coating cement concrete prevents water leakage with good follow-up capacity and without damage occurring even when cracks are generated in the tunnel itself, waterproofing capacity is increased to a great extent by comparison to conventional waterproofing construction methods.

Examples of waterproofing sheets that are adhesive with secondary coating cement concrete include uncrosslinked rubber sheets such as isoprene rubber and natural rubber.

The waterproofing sheet that is adhesive with the secondary coating cement concrete may also contain antioxidants, ultraviolet radiation absorbents and tackiness-decreasing agents.

In this invention, it is desirable to laminate the layer having adhesiveness with the secondary cement concrete with a polymeric sheet from the standpoint of increasing the insulation effect with the secondary coating cement concrete if it has been bound with the earth mound. When a layer that is adhesive with the secondary coating cement concrete and a multilayer waterproofing sheet that is laminated with a polymeric sheet are used, they are installed so that the primary spray cement concrete surface side and the polymeric sheet are in contact and the secondary coating cement concrete is installed on the waterproofing sheet surface side that is adhesive with the secondary coating cement concrete.

Examples of the material of the polymeric sheet can include high-density polyethylene, low-density polyethylene, copolymers of ethylene vinyl acetate (EVA) and polypropylene. Of these, high-density polypropylene is preferable from the standpoint of insulation effect, strength, crack follow-up capacity and price.

In this invention, a buffer-water conducting layer may be established before installing the waterproofing sheet that is adhesive with the secondary coating cement concrete for the purpose of increasing the insulation effect, decreasing water pressure in sites in which there is a great deal of groundwater and increasing the waterproofing effect. Examples of buffer-waterproofing layers can include layers that are formed by spraying a fibrous substance such as pulp nonwoven fabrics of fibers such as polyester fibers and polypropylene and plates or irregular shapes.

The waterproofing construction method can be used in the bedding portion of the tunnel and displays great effectiveness in preventing water leakage from the bedding component.

There are no particular limitations on the method of affixing the waterproofing sheet, nonwoven fabric and plates of irregular shape to the primary spray cement concrete surface and adhesive agents and rivets may be used.

After the waterproofing sheet that is adhesive to the secondary coating cement concrete has been installed in this way, the secondary coating cement concrete is applied and construction is completed.

EXAMPLES

We shall now describe this invention in detail on the basis of examples.

Example 1

A U-shaped simulation tunnel having openings of 4 m, a height of 3.5 m and a length of 3 m was made. Irregularities of the tunnel earth mound surface were presumed in the simulation tunnel and fifteen concrete blocks of 15 cm in width, 20 cm in height and 20 cm in length were installed at suitable intervals to form an irregular surface.

Fast-drying mortar was used as the primary spray mortar and was sprayed so that the fast-drying mortar was 10 cm in thickness.

After spraying, a multilayer waterproofing sheet having adhesiveness to the secondary coating concrete (brand name, "Preprufe 300," manufactured by the Grace Construction Products Company of the United States; a two-layer sheet comprised of two layers, a layer having adhesiveness to concrete and a polyethylene layer; 2.7 mm in thickness) was affixed by riveting to the primary spray mortar surface. Following that, the secondary coating concrete was applied to a thickness of 30 cm. To simulate damage to the multilayer waterproofing sheet, cuts were made in a part of it.

Twenty-eight days after the secondary coating concrete was established, a test sample was cut out by boring and adhesiveness with the concrete was checked. The secondary coating concrete and the waterproofing sheet were in good contact and were a single entity. The peeling strength of the secondary coating concrete and the waterproofing sheet was greater than 0.9 N/mm.

A single entity with the secondary coating concrete was also well maintained in the region of the cut, with the cut in the concrete being in a linear pattern of less than 2 mm. A static water pressure of 60 m was applied in the gap between the primary spray concrete and the multilayer waterproofing sheet. However, water did not enter into the gap between the multilayer waterproofing sheet and the secondary coating concrete, with good waterproofing capacity being shown.

Because the multilayer waterproofing sheet that was used had adhesiveness, the multilayer waterproofing sheets could be adhered to each other satisfactorily simply by superimposing the ends of the multilayer waterproofing sheets on each other. For this reason, execution capacity was extremely good and an excellent value of 1.7 N/mm was obtained for adhesive strength of the superimposed parts.

To simulate cracks in the tunnel, stress was applied to the secondary coating concrete and cracks were made. No abnormalities were seen in the multilayer waterproofing sheet.

The test methods for the various physical properties were as follows.

Adhesive strength with the concrete: In accordance with ASTM D 903 (90 degree peeling strength). Adhesive strength of superimposed portions: In accordance with ASTM D 1876 (Determinations in the case in which multilayer waterproofing sheets are superimposed).

Example 2

The same procedure was carried out as in Example 1 except that the multilayer waterproofing sheet having adhesiveness with the secondary coating concrete that was used was a product of the brand name "Santacket* Sheet" (isoprene rubber waterproofing sheet, a nonwoven fabric lined product, manufactured by Hayakawa Rubber).

*Phonetic spelling—Trans. note.

Twenty-eight days after the secondary coating concrete was established, a test sample was cut out by boring and adhesiveness with the concrete was checked. The secondary coating concrete and the waterproofing sheet were in good contact and were a single entity.

However, it was more difficult to join the ends of the multilayer waterproofing sheets than in Example 1 and workability was also somewhat difficult.

Comparative Example 1

The same procedure was carried out as in Example 1 except that a waterproofing sheet made of EVA (which did not have adhesiveness with the secondary coating concrete) was used instead of a multilayer waterproofing sheet having adhesiveness with the secondary coating concrete.

When pressure corresponding to 30 m of static water pressure was applied between the primary spray mortar and waterproofing sheet, it was found from the cracks in which damage was presumed that a large quantity of water entered into the gap between the waterproofing sheet and the secondary coating concrete and that properties of a waterproofing sheet were not obtained.

[Effect of the Invention]

By making the secondary coating cement concrete and the waterproofing sheets into a single entity using the waterproofing sheets of this invention having adhesiveness with the secondary coating cement concrete, water does not infiltrate between the gap between the waterproofing sheets and the secondary coating concrete and excellent waterproofing capacity can be assured even if a part of the waterproofing sheets is damaged.

Further, the crack follow-up of the waterproofing sheets of this invention is good, the waterproofing sheets are not damaged and excellent waterproofing capacity can be assured even if cracks develop in the secondary coating cement concrete. Even if by any chance the crack width is large and damage of the waterproofing sheet occurs, because the other portions of the waterproofing sheet are a single entity with the secondary coating cement, water does not infiltrate into the gap between the waterproofing sheets and the secondary coating concrete; therefore, the industrial benefits are extremely great.

What is claimed is:

1. A tunnel waterproofing method comprising: spraying a primary layer of cement concrete on the excavation surface of the tunnel, establishing on the primary cement concrete layer a buffer-water conducting layer by affixing a nonwoven fabric, a fibrous material, or plates of irregular shapes, establishing on said buffer-water conducting layer a waterproofing membrane having a plastic or rubber sheet and an adhesive layer operative to adhere with a secondary coating concrete applied on said waterproofing membrane, and spraying onto said waterproofing membrane a secondary coating of cement concrete, thereby achieving waterproofing of the tunnel.

2. The tunnel waterproofing method as described in claim 1, wherein said waterproofing membrane has a polymeric sheet comprising high-density polyethylene, low density polyethylene, copolymers of ethylene vinyl acetate, polypropylene, or mixture thereof.

3. The tunnel waterproofing method of claim 2 wherein said polymeric sheet is polyethylene.

4. The tunnel waterproofing method of claim 1 wherein said sheet comprises an uncrosslinked rubber.

5. The tunnel waterproofing method of claim 4 wherein said uncrosslinked rubber comprises isoprene rubber, natural rubber, or mixture thereof.

6. The tunnel waterproofing method of claim 1 wherein said waterproofing membrane is formed by superimposing ends of adjacent waterproofing sheets on each other.

7. The tunnel waterproofing method of claim 1 wherein said establishing of a buffer water conducting layer comprises spraying a fibrous substance.

8. The tunnel waterproofing method of claim 1 wherein said establishing of a buffer water conducting layer comprises spraying fibers comprising polyester, polypropylene, or mixture thereof.

9. The tunnel waterproofing method of claim 1 wherein said establishing of a buffer-water conducting layer comprises affixing plates of irregular shapes.

10. The tunnel waterproofing method of claim 1 wherein said establishing of a buffer-water conducting layer comprises affixing a nonwoven fabric using an adhesive or rivets.

11. The tunnel waterproofing method of claim 1 wherein said tunnel is a U-shaped tunnel.

* * * * *